US009359792B1

(12) United States Patent
Liao

(10) Patent No.: US 9,359,792 B1
(45) Date of Patent: Jun. 7, 2016

(54) COMBINATION OF LOCK WITH ADJUSTABLE KEY AND CORE

(71) Applicant: Bloftown Co., Ltd., New Taipei (TW)

(72) Inventor: Hung-Lin Liao, New Taipei (TW)

(73) Assignee: Bloftown Co., Ltd., New Taipei (TW)

( * ) Notice: Subject to any disclaimer, the term of this patent is extended or adjusted under 35 U.S.C. 154(b) by 0 days.

(21) Appl. No.: 14/834,995

(22) Filed: Aug. 25, 2015

(51) Int. Cl.

| | |
|---|---|
| ***E05B 19/08*** | (2006.01) |
| ***E05B 27/04*** | (2006.01) |
| ***E05B 27/00*** | (2006.01) |
| ***E05B 19/00*** | (2006.01) |
| *E05B 19/18* | (2006.01) |

(52) U.S. Cl.

CPC ..... *E05B 27/005* (2013.01); *E05B 19/0017* (2013.01); *E05B 19/0035* (2013.01); *E05B 19/18* (2013.01); *E05B 27/001* (2013.01); *E05B 27/0014* (2013.01); *Y10T 70/7605* (2015.04); *Y10T 70/7678* (2015.04); *Y10T 70/7746* (2015.04); *Y10T 70/7893* (2015.04)

(58) Field of Classification Search

CPC ... E05B 19/18; E05B 27/001; E05B 27/0014; E05B 27/0042; E05B 27/0075; E05B 27/005; E05B 19/0017; E05B 19/24; E05B 19/0035; Y10T 70/7881; Y10T 70/7893; Y10T 70/7661; Y10T 70/7667; Y10T 70/7672; Y10T 70/7678; Y10T 70/7684; Y10T 70/7746; Y10T 70/7605

USPC ..... 70/382–385, 372–375, 493, 411, 432, 70/409, 403, 404, 460, 367, 371, DIG. 44

See application file for complete search history.

(56) References Cited

U.S. PATENT DOCUMENTS

| | | | | | |
|---|---|---|---|---|---|
| 939,679 | A * | 11/1909 | Freud | E05B 19/18 | 70/411 |
| 1,107,376 | A * | 8/1914 | Thiman | E05B 29/00 | 70/377 |
| 1,252,606 | A * | 1/1918 | Neubauer | E05B 19/18 | 70/411 |
| 1,433,363 | A * | 10/1922 | Freysinger | E05B 9/04 | 70/373 |
| 1,826,615 | A * | 10/1931 | Hansen | E05B 19/18 | 70/411 |
| 2,430,914 | A * | 11/1947 | Americo | E05B 19/18 | 70/411 |
| 3,427,413 | A * | 2/1969 | Maddison | E05B 45/06 | 200/43.08 |
| 3,810,416 | A * | 5/1974 | Nelms, Jr. | B23Q 35/42 | 409/130 |
| 4,068,509 | A * | 1/1978 | Genakis | E05B 27/00 | 70/373 |
| 4,287,735 | A * | 9/1981 | Brunken | E05B 19/18 | 70/395 |
| 4,292,824 | A * | 10/1981 | Keller | E05B 9/042 | 70/373 |
| 7,162,900 | B1 * | 1/2007 | Lu | E05B 19/18 | 70/398 |
| 2004/0103703 | A1 * | 6/2004 | Bardachenko | E05B 35/001 | 70/411 |

* cited by examiner

*Primary Examiner* — Lloyd Gall

(74) *Attorney, Agent, or Firm* — C. G. Mersereau; Nikolai & Mesereau, P.A.

(57) ABSTRACT

A combination of a lock and a key includes a cylinder having a housing, multiple index rings and multiple cores. The housing has slot laterally defined through the wall thereof the housing. At least one first post and at least one second post respectively extend radially from the first end and the second end of the housing. The index rings are located in the housing and each have at least one column with a first mark. At least one cap restricts the index rings to the housing. Each index ring has one core received therein. The key has a handle, a shaft and multiple unlocking members mounted to the shaft. Each unlocking members has a second mark and a top portion. The index rings are removed and re-arranged by removing the cap via the slot so as to obtain different combinations by the first and second marks.

8 Claims, 10 Drawing Sheets

COMBINATION OF LOCK WITH ADJUSTABLE KEY AND CORE

BACKGROUND OF THE INVENTION

1. Field of the Invention

The present invention relates to a combination of a lock and a key, and more particularly, to a lock with adjustable cores and an adjustable key.

2. Description of the Prior Art

The conventional lock generally comprises a cylinder received in a cast, and the cylinder includes a housing, a core and multiple bead units.

The housing of the cylinder is a cylindrical member and has a room defined in a center thereof. The housing has multiple outer bead holes defined through the wall thereof. The core is a cylindrical member and has a keyhole defined therein. The core has multiple inner bead holes on an outside thereof, the inner bead holes communicate with the keyhole. The core is rotatably located in the housing, and the inner bead holes are located corresponding to the outer bead holes.

Each of the bead units includes an outer bead, an inner bead and a resilient member. The bead units are inserted in the corresponding inner and outer bead holes, wherein the outer bead and the resilient member are located in the outer bead hole, and the resilient member pushes the outer bead whose inner end slightly protrudes beyond the inner bead hole. The inner bead is located in the inner bead hole, and the outer end of the inner bead is in contact with the inner end of the outer bead so that the inner end of the inner bead movably protrudes beyond the keyhole. The inner bead and the outer bead of each bead unit has its own length which is made to be matched with the cuts of the key. When the key is inserted into the keyhole, the inner beads are matched with the cuts of the key so that the inner and outer beads are moved to a position where the contact portion between the inner and outer beads is located at the surface between the core and the housing. Therefore, the key may rotate to rotate the core to unlock the lock.

The length of the inner and outer beads of the existed lock is designed specifically for a correct key. If multiple locks are used, then multiple keys are prepared to unlock the locks individually. However, the multiple keys need a space to store, and most of the keys look alike. Once the key is lost, if a spare key is available, the user needs to duplicate another one, otherwise, the whole lock has to be replaced to prevent unauthorized access to the lock.

The present invention intends to provide a combination of a lock and a key, wherein the cores are adjustable and the key is adjustable so as to eliminate the shortcomings mentioned above.

SUMMARY OF THE INVENTION

The present invention relates to a combination of a lock and a key, and comprises a cylinder having a housing, multiple index rings and multiple cores. The housing has a passage defined axially therethrough. A slot is laterally defined through the wall of the housing. At least one first post extends radially from the first end of the housing, and at least one second post extends radially from the second end of the housing. The index rings are located in the passage and each index ring has at least one column extending radially therefrom which extends through the slot and has a first mark. At least one cap restricts the index rings to the housing. Each index ring has one of the cores received therein. A key has a handle, a shaft and multiple unlocking members. The handle is connected to one end of the shaft by a control member. Each unlocking members has a mounting hole through which the shaft of the key extends. Each unlocking member has a second mark and a top portion.

The index rings are removed and re-arranged via the slot by removing the cap. Different combinations are created by matching the first marks of the index rings and the second marks of the unlocking members of the key.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
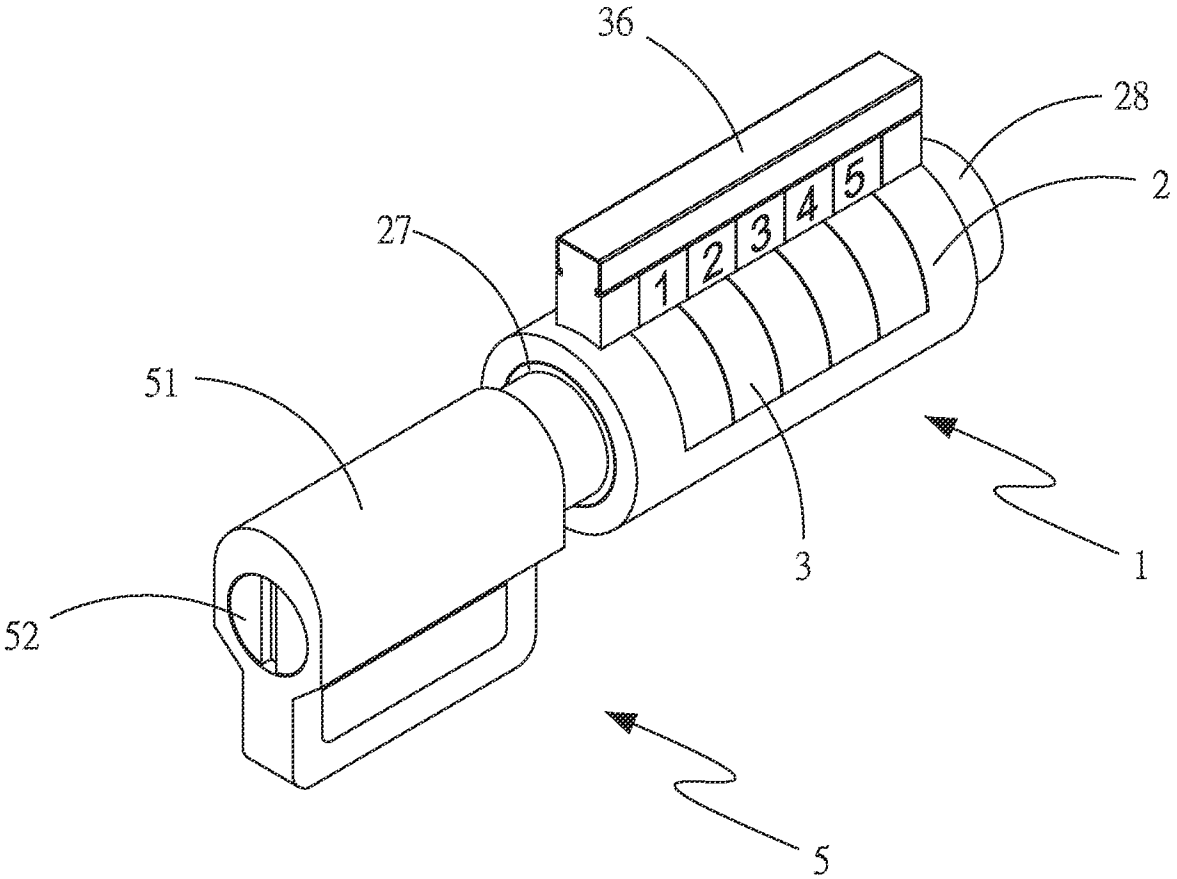
FIG. 1 is a perspective view to show the cylinder of the lock and the key of the present invention.

Referring to FIGS. 1 to 4, the combination of a lock and a key of the present invention comprises a cylinder 1 having a housing 2, multiple index rings 3 and multiple cores 4. The housing 2 has a passage 21 defined axially therethrough, and a slot 211 is laterally defined through the wall of the housing 2. The housing 2 has a first opening 212 and a second opening 213 respectively defined in the first and second ends thereof. At least one first post 22 extends radially from the first end of the housing 2, and at least one second post 23 extends radially from the second end of the housing 2. The at least one first post 22 has a positioning protrusion 25 which faces the slot 211. The at least one second post 23 has a positioning recess 26 which faces the slot 211. Each of the at least one first post 22 and the at least one second post 23 has a first slit 24 defined in at least one side thereof. A positioning ring 27 is connected to the first opening 212, and an end ring 28 is connected to the second opening 213. The positioning ring 27 has a tab 271 protruding therefrom and located corresponding to the positioning protrusion 25. The end ring 28 has a groove 281 which is located corresponding to the positioning recess 26.

The index rings 3 are located in the passage 21 and each index ring 3 has at least one column 31 extending radially therefrom which extends through the slot 211 and has a first mark 311. The index rings 3 each have a first part 34 protruding from the first side thereof and a first notch 35 defined in the second side thereof.

Each core 4 has a second part 41 and a second notch 42 on two opposite sides thereof. Each core 4 is received in one of the index rings 3 corresponding thereto. The first notch 35 of the index ring 3 located at the first end of the housing 2 is engaged with the positioning protrusion 25 of the at least one first post 22. The second notch 42 of the core 4 in the index ring 3 at the first end of the housing 2 is engaged with the tab 271 of the positioning ring 27. The first part 34 of the index ring 3 and the second part 41 of the core 4 are respectively engaged with the first notch 35 and the second notch 42 of the adjacent index ring 3 and the adjacent core 4. The first part 34 of the index ring 3 located at the second end of the housing 2 is engaged with the positioning recess 26 of the at least one second post 23. The second part 41 of the core 4 received in the index ring 3 located at the second end of the housing 2 is engaged with the groove 281 of the end ring 28. The column 31 of each index ring 3 has a second slit 312 defined in at least one side thereof. The second slit 312 of each index ring 3 is located corresponding to the first slit 24 of each of the at least one first post 22 and the at least one second post 23. A cap 36 has at least one flange which is engaged with the first and second slits 24, 312 to position the index rings 3 to the housing 2. The column 31 of each index ring 3 has a reception hole 313. A push member 32 and a resilient member 33 are received in each reception hole 313. The resilient member 33 biases the push member 32. Each core 4 has at least one bead hole 43 in which an inner bead 44 is received. The inner bead 44 in each of the at least one bead hole 43 has one end thereof biasing the push member 32, and the other end of the inner bead 44 protrudes beyond the core 4. The push members 32 and the inner beads 44 in each corresponding reception hole 313 and the at least one bead hole 43 have different ratio of length.

Figure 2:
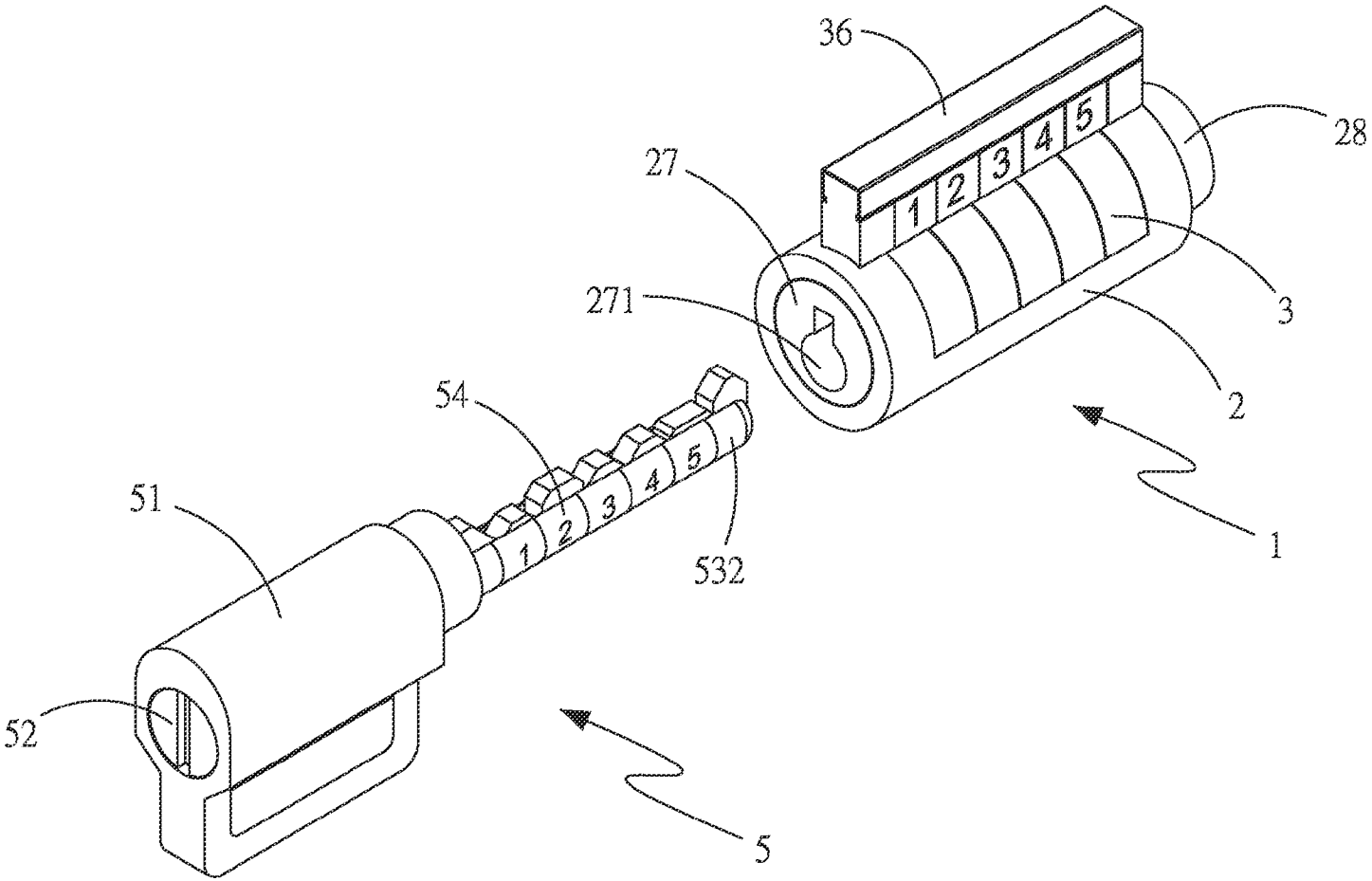
FIG. 2 is an exploded view to show the cylinder of the lock and the key of the present invention.
Figure 3:
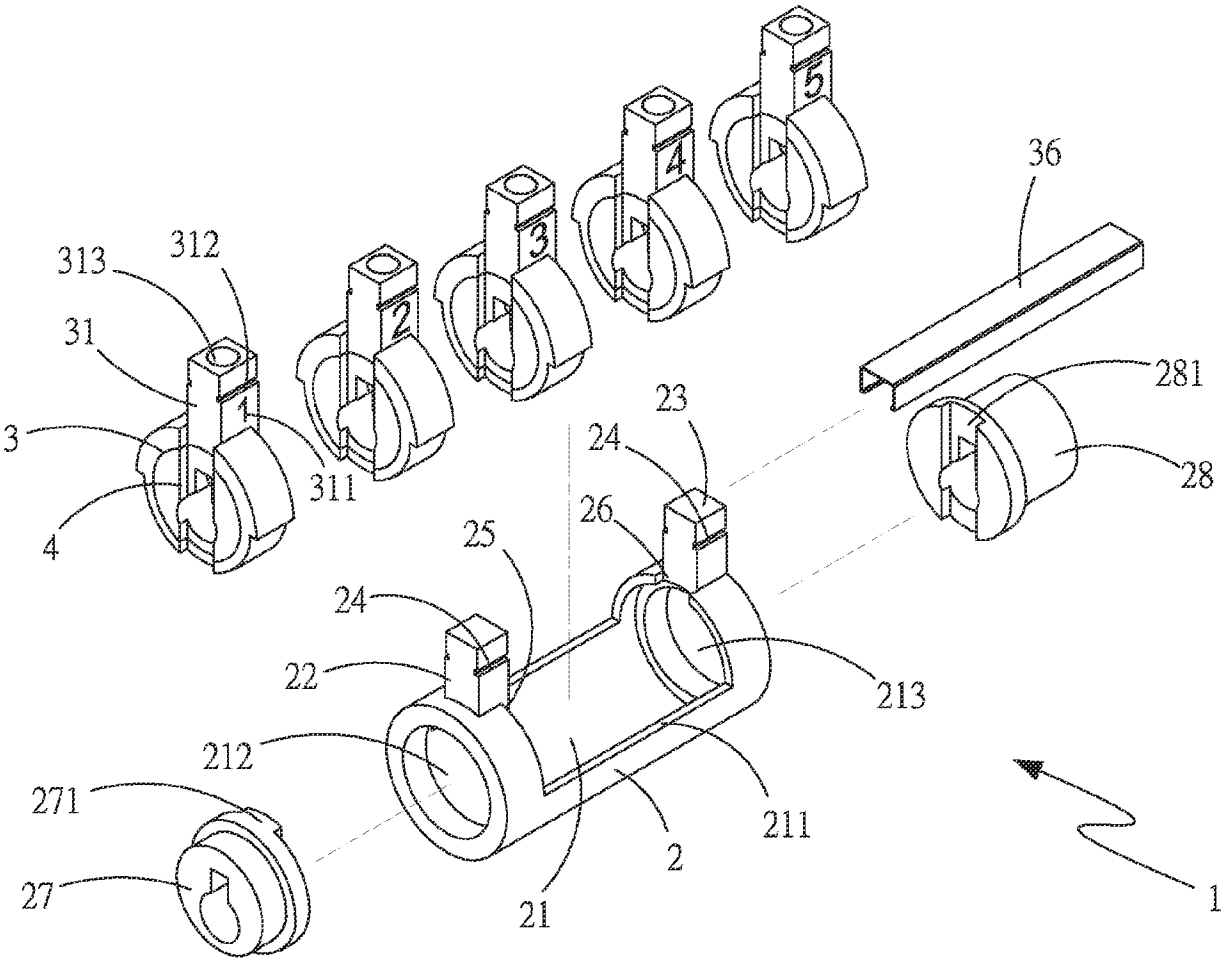
FIG. 3 is an exploded view to show the cylinder of the lock of the present invention.
Figure 5:
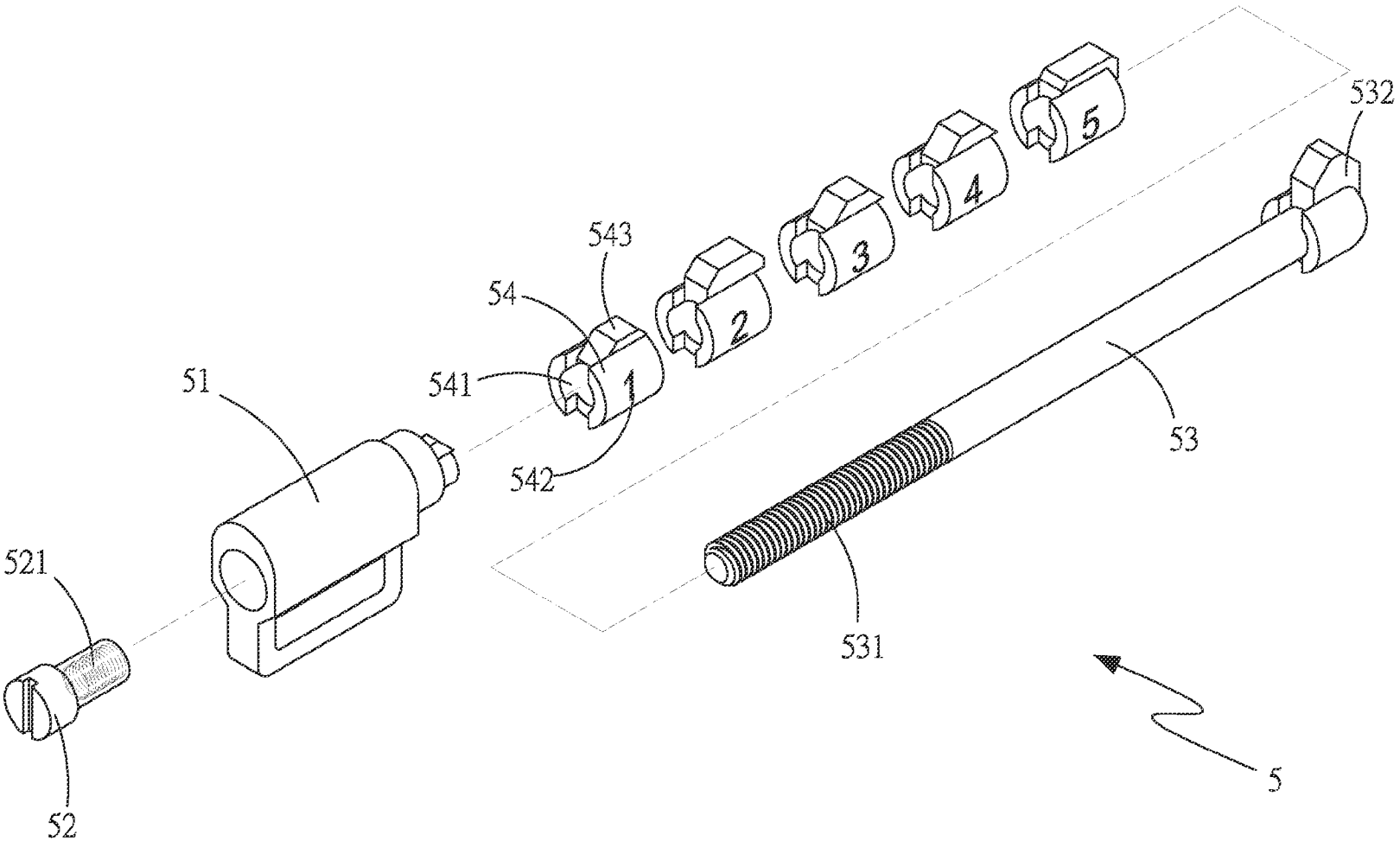
FIG. 5 is an exploded view to show the key of the present invention.

As shown in FIGS. 2 and 5, a key 5 has a handle 51, a shaft 53 and multiple unlocking members 54. The handle 51 is connected to outer threads 531 on one end of the shaft 53 by a control member 52. Specifically, the control member 52 is located in the handle 51 and has inner threads 521 which are threadedly connected to the outer threads 531 of the shaft 53. Each unlocking members 54 has a mounting hole 541 through which the shaft 53 of the key 5 extends. Each unlocking member 54 having a second mark 542 and a top portion 543. The top portions 543 of the unlocking members 54 may have different heights so as to be cooperated with the inner beads 44 of different lengths. The shaft 53 has an end portion 532 on the distal end thereof.

Figure 6:
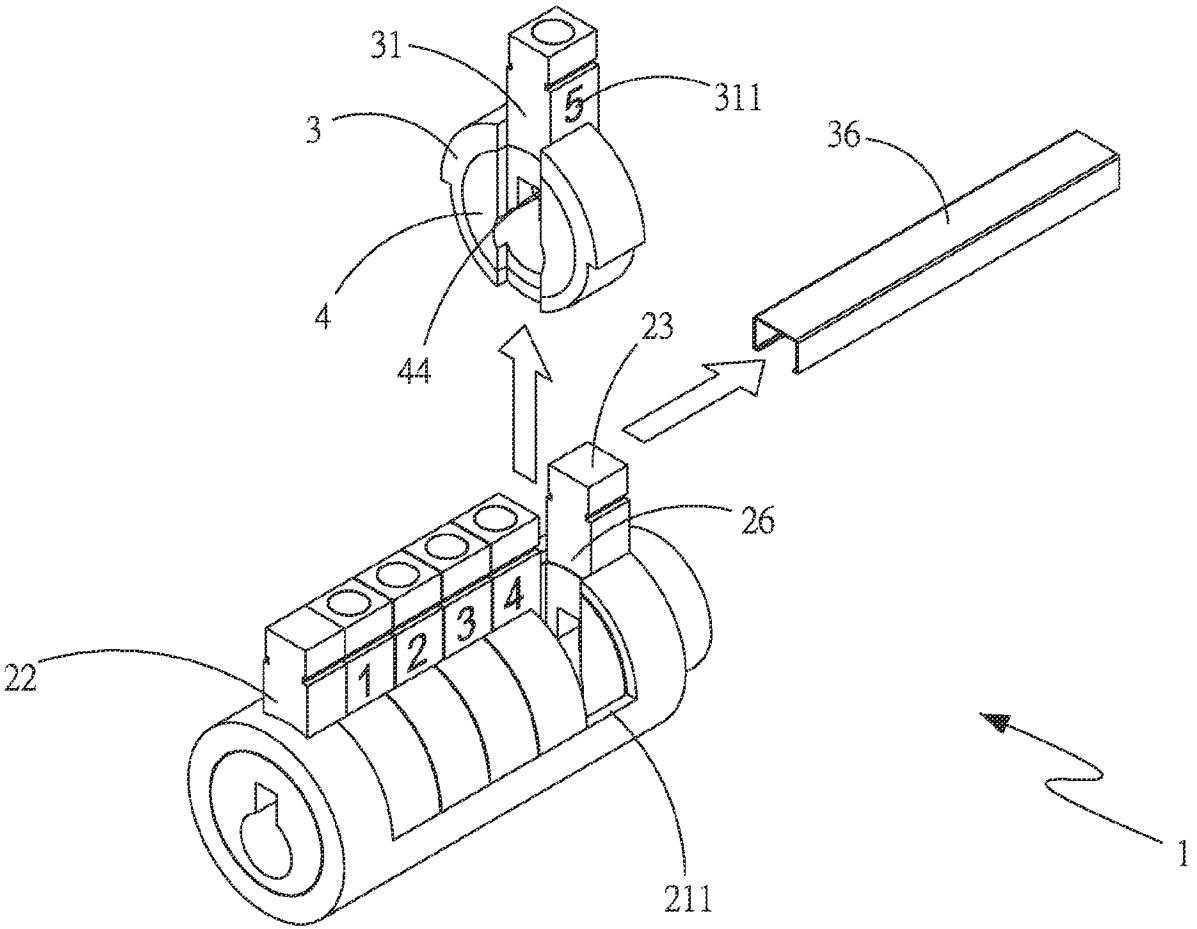
FIG. 6 shows the index rings are removed by removing the cap.
Figure 7:
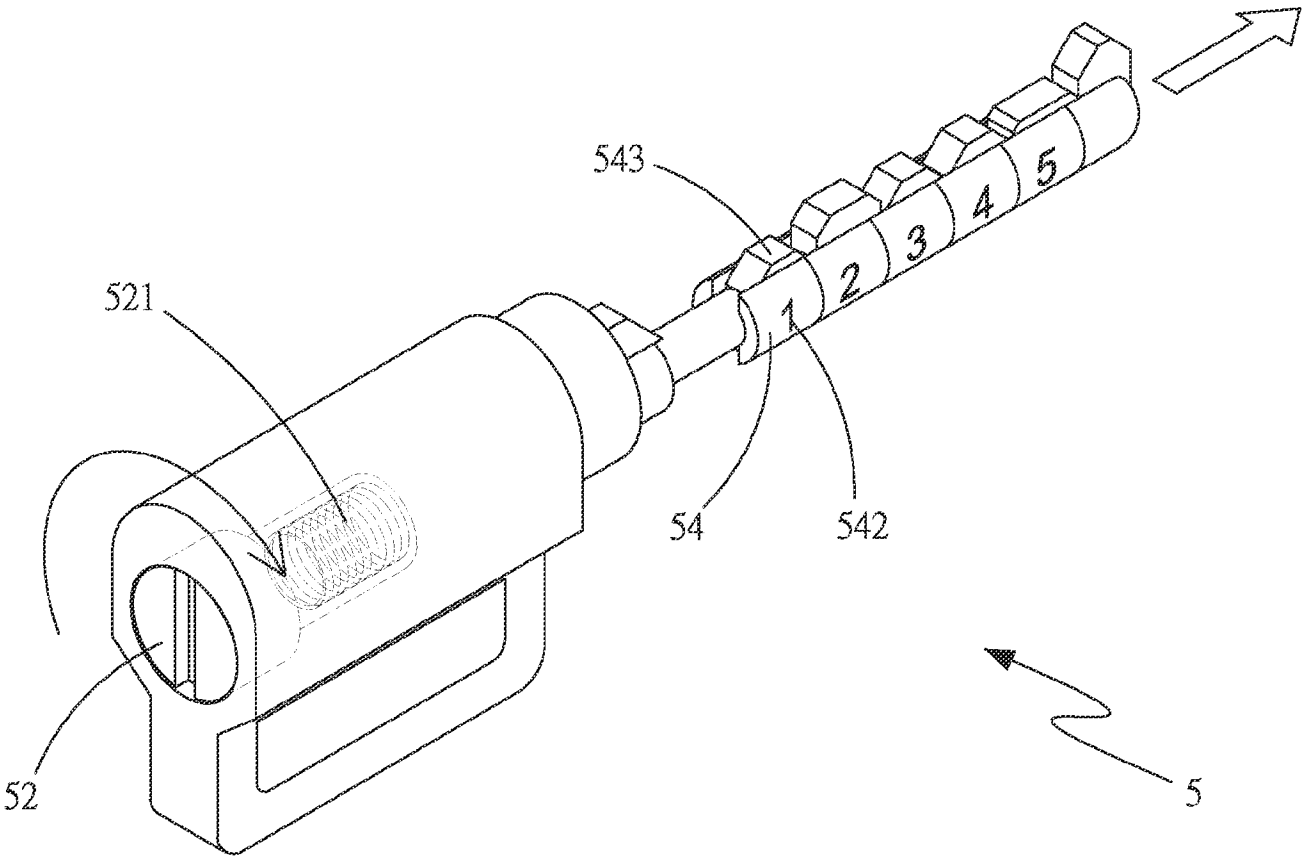
FIG. 7 shows the key of the present invention.
Figure 8:
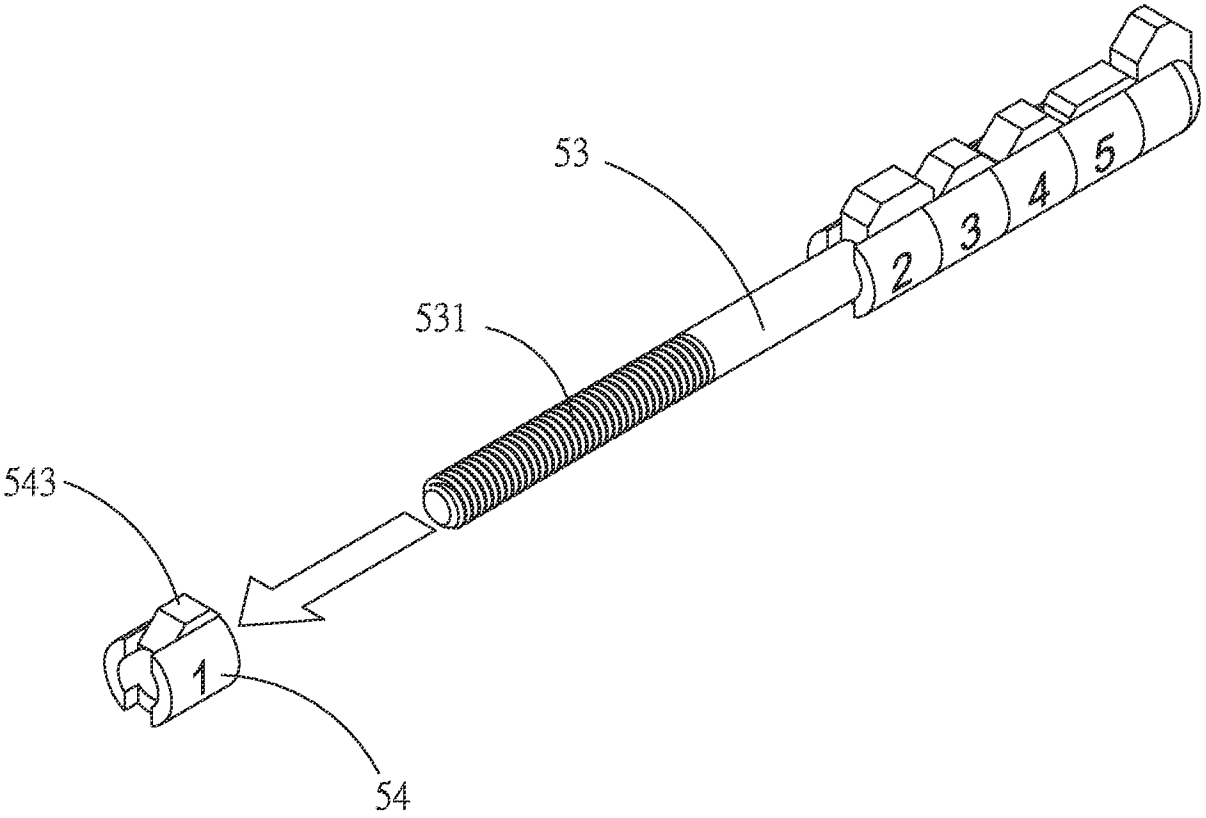
FIG. 8 shows that the unlocking member is to be mounted to the shaft of the key of the present invention.

As shown in FIGS. 6 to 8, the index rings 3 can be removed and re-arranged via the slot 211 by removing the cap 36 which is then removed from the at least one first post 22 and the at least one second post 23. The index ring 3 and the core 4 in the index ring 3 at the second end of the housing 2 are removed from the positioning recess 26 of the at least one post 23 and can be picked out from the slot 211. The index rings 3 can also be removed from the slot 211 one by one, and then re-arranged to the shaft 53 of the key 5. Similarly, the control member 52 can be unthreaded and removed from the shaft 53, the unlocking members 54 can be re-arranged. By aligning the second marks 542 on the unlocking members 54 relative to the first marks 311 of the index rings 3, different combinations are created. The top portion 543 of each unlocking member 54 is located corresponding to the inner bead 44 of corresponding length. After the arrangement is done, the control member 52 is connected to the shaft 53 again. Therefore, the key 5 and the cylinder 1 can be matched.

Figure 4:
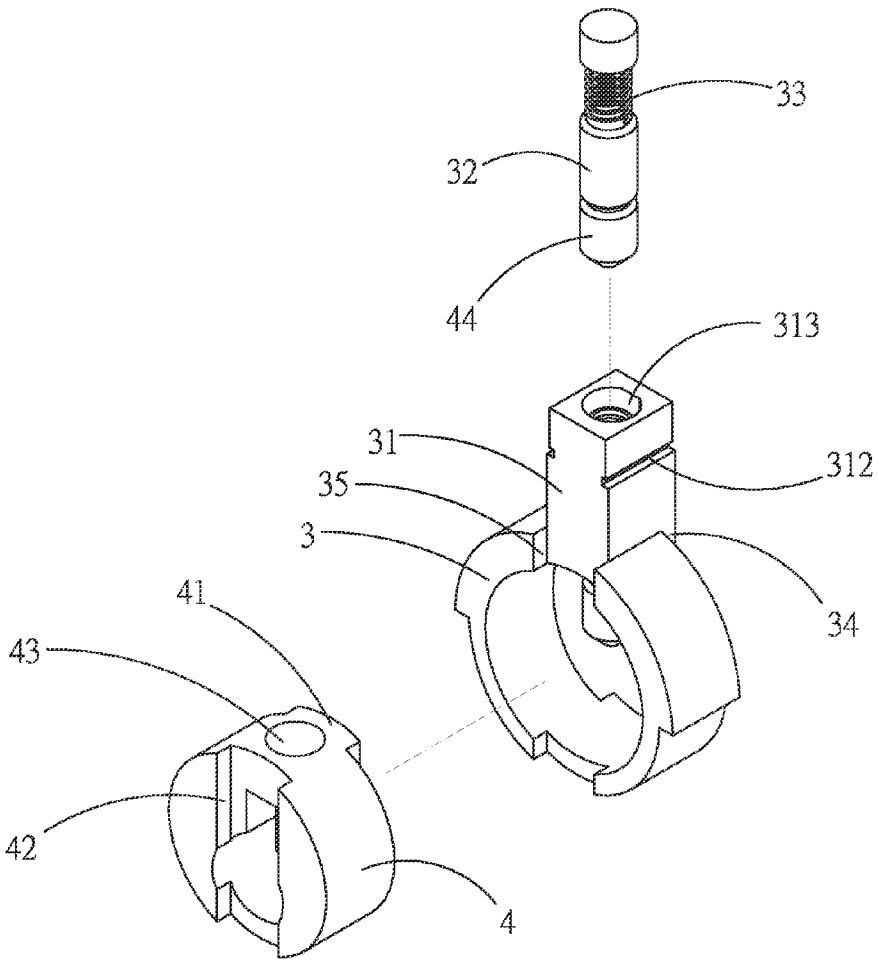
FIG. 4 shows the index ring, the core, the resilient member and the push member of the cylinder of the present invention.
Figure 9:
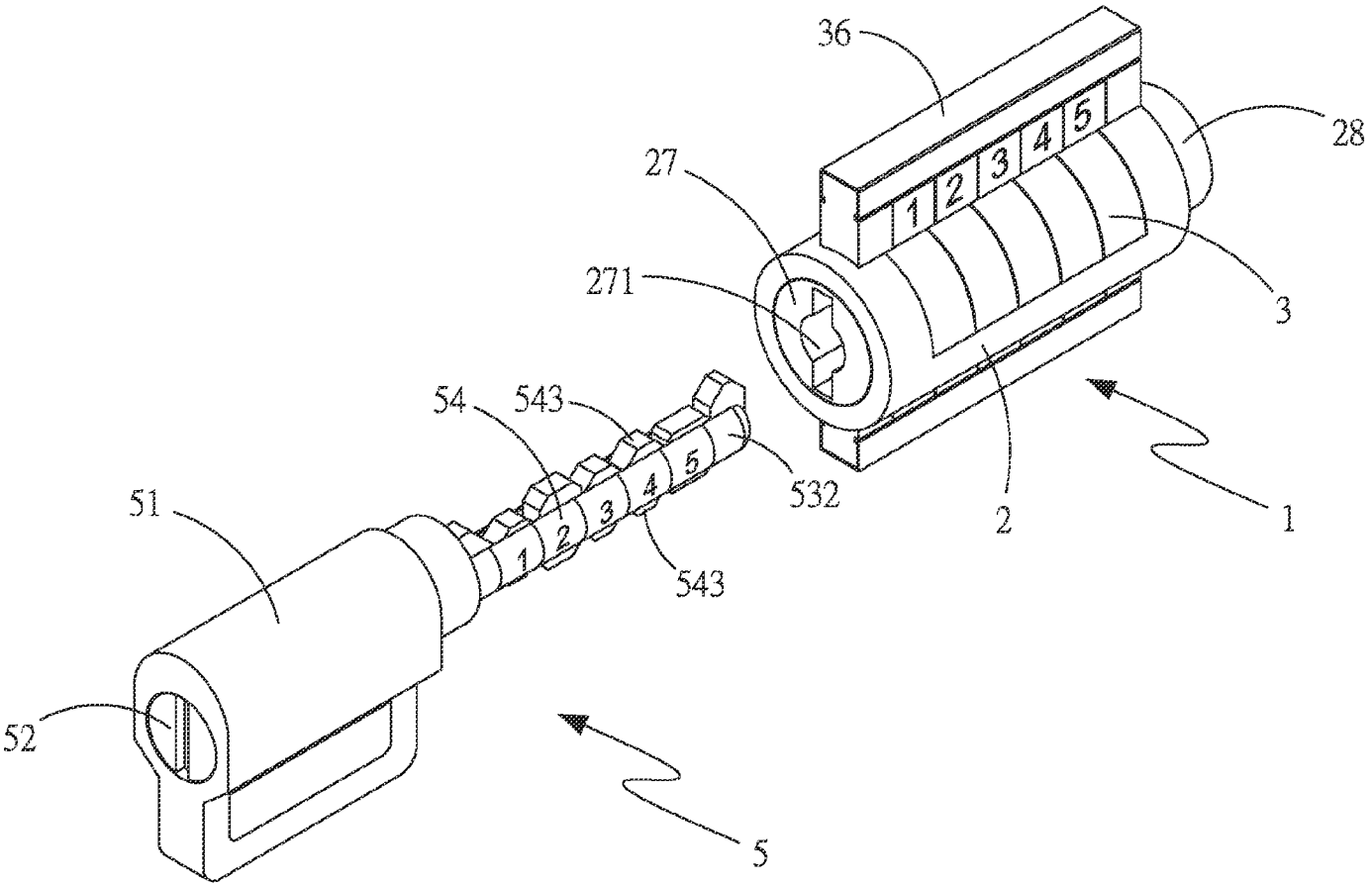
FIG. 9 shows that the second embodiment of key is to be inserted into the second embodiment of the cylinder of the present invention.
Figure 10:
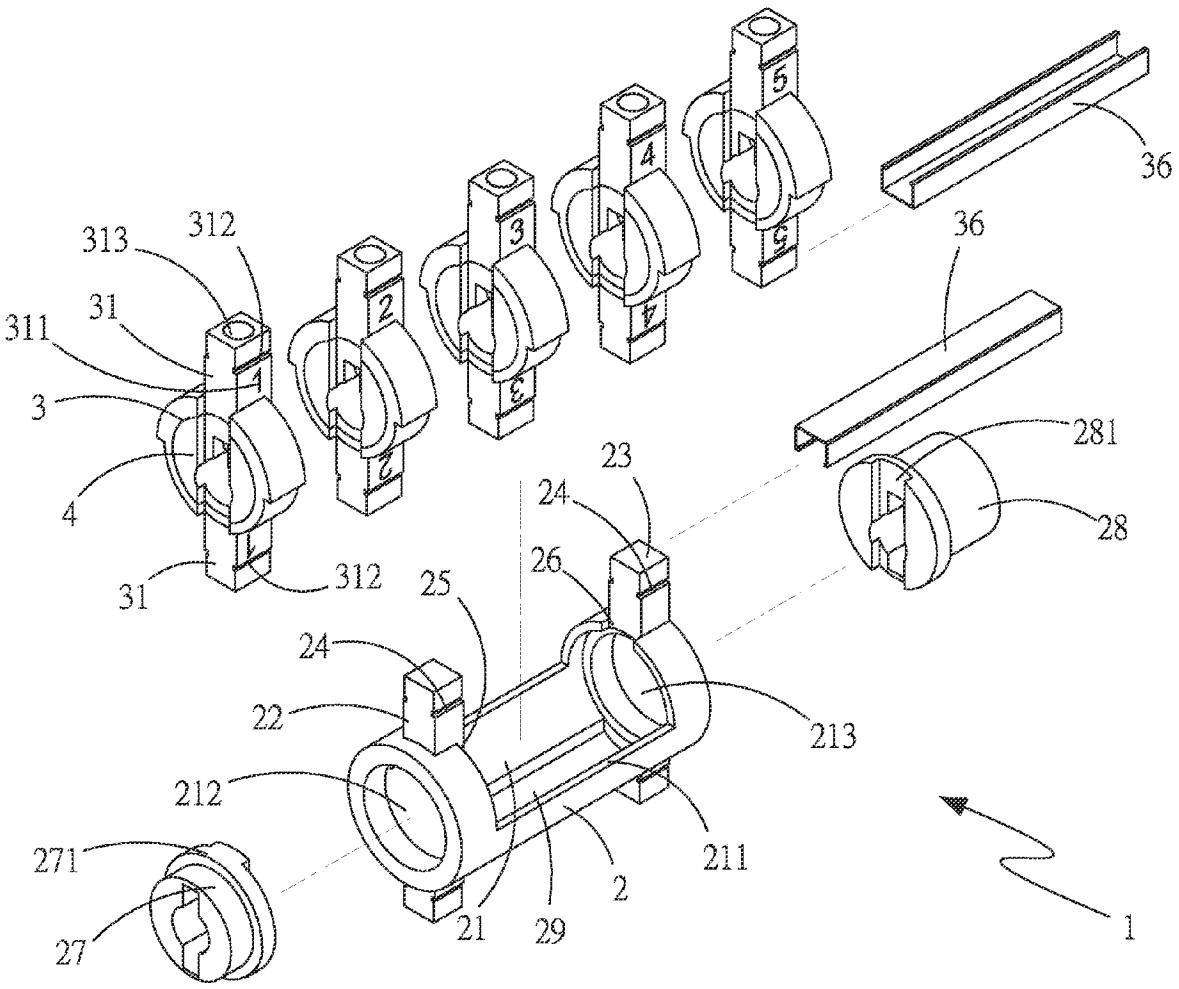
FIG. 10 is an exploded view to show the second embodiment of the cylinder of the cylinder of the present invention.

As shown in FIGS. 9 and 10, in another embodiment of the present invention, the housing 2 has at least one through hole 29 defined through the wall thereof. Another first post 22 extends radially from the first end of the housing 2 and is located corresponding to one end of the at least one through hole 29. Another second post 23 extends radially from the second end of the housing 2 and is located corresponding to the other end of the at least one through hole 29. Each of the another first post 22 and the another second post 23 has another first slit 24. Each of the index rings 3 has another column 31 extending through the at least one through hole 29 and the another column 31 has another first mark 311 and another second slit 312. Another cap 36 is engaged with the first and second slits 24, 312 to position the index rings 3 to the housing 2. Similarly, each unlocking member 54 has another top portion 543 corresponding to the at least one through hole 29, and the another top portion 543 is located corresponding to the inner bead 44 of corresponding length so as to unlock or lock the lock as shown in FIGS. 4 and 5. By this way, more combinations can be used to increase the safety feature of the lock.

While we have shown and described the embodiment in accordance with the present invention, it should be clear to those skilled in the art that further embodiments may be made without departing from the scope of the present invention.

What is claimed is:

1. A combination of a lock and a key, comprising:

a cylinder having a housing, multiple index rings and multiple cores, the housing having a passage defined axially therethrough, a slot laterally defined through a wall of the housing, at least one first post extending radially from a first end of the housing, at least one second post extending radially from a second end of the housing;

the index rings located in the passage and each index ring having at least one column extending radially therefrom which extends through the slot and has a first mark, at least one cap restricting the index rings to the housing, each index ring having one of the cores received therein;

a key having a handle, a shaft and multiple unlocking members, the handle connected to outer threads on one end of the shaft by a control member, each unlocking member having a mounting hole through which the shaft of the key extends, each unlocking member having a second mark and a top portion, and the index rings being removed and re-arranged via the slot by removing the cap, different combinations being created by matching the first marks of the index rings and the second marks of the unlocking members of the key.

2. The combination as claimed in claim 1, wherein the at least one first post has a positioning protrusion which faces the slot, the at least one second post has a positioning recess which faces the slot, the housing has a first opening and a second opening respectively defined in the first and second ends thereof, a positioning ring is connected to the first opening, an end ring is connected to the second opening, the positioning ring has a tab protruding therefrom and located corresponding to the positioning protrusion, the end ring has a groove which is located corresponding to the positioning recess.

3. The combination as claimed in claim 2, wherein the index rings each have a first part protruding from a first side thereof and a first notch defined in a second side thereof, each core has a second part and a second notch on two opposite sides thereof, the first notch of the index ring located at the first end of the housing is engaged with the positioning protrusion of the at least one first post, the second notch of the core in the index ring at the first end of the housing is engaged with the tab of the positioning ring, the first part of the index ring and the second part of the core are respectively engaged with the first notch and the second notch of the adjacent index ring and the adjacent core, the first part of the index ring located at the second end of the housing is engaged with the positioning recess of the at least one second post, the second part of the core received in the index ring located at the second end of the housing is engaged with the groove of the end ring.

4. The combination as claimed in claim 1, wherein each of the at least one first post and the at least one second post has a first slit defined in at least one side thereof, the column of each index ring has a second slit defined in at least one side thereof, the cap has at least one flange which is engaged with the first and second slits to position the index rings to the housing.

5. The combination as claimed in claim 4, wherein the column of each index ring has a reception hole, a push member and a resilient member are received in each reception hole, the resilient member biases the push member, each core has at least one bead hole in which an inner bead is received, the inner bead in each of the at least one bead hole has one end biasing the push member, the other end of the inner bead protrudes beyond the core, the push members and the inner beads in each corresponding reception hole and the at least one bead hole have different ratio of length.

6. The combination as claimed in claim 1, wherein the shaft has an end portion on a distal end thereof.

7. The combination as claimed in claim 1, wherein the control member is located in the handle and has inner threads which are threadedly connected to the outer threads of the shaft.

8. The combination as claimed in claim 5, wherein the housing has at least one through hole defined through the wall thereof, another first post extends radially from the first end of the housing and is located corresponding to one end of the at least one through hole, another second post extends radially from the second end of the housing and is located corresponding to the other end of the at least one through hole, each of the index rings has another column extending through the at least one through hole and the another column has another first mark and another second slit, another cap is engaged with the first and second slits to position the index rings to the housing.

* * * * *